US006488479B1

(12) United States Patent
Berger

(10) Patent No.: US 6,488,479 B1
(45) Date of Patent: Dec. 3, 2002

(54) VARIABLE PRESSURE OIL PUMP

(75) Inventor: Alvin Henry Berger, Brownstown, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/681,659

(22) Filed: May 17, 2001

(51) Int. Cl.[7] ..... F04B 49/00; F01M 9/00; F16N 13/02; F16K 15/00

(52) U.S. Cl. ..... 417/310; 417/440; 123/196 R; 184/6.3; 184/34; 137/522

(58) Field of Search ..... 417/310, 440; 123/196 R; 184/6.3, 6.21, 34; 137/522, 523; 251/25

(56) References Cited

U.S. PATENT DOCUMENTS

| | | | | | |
|---|---|---|---|---|---|
| 2,140,735 | A | | 12/1938 | Clarke et al. | |
| 3,791,408 | A | * | 2/1974 | Saitou et al. | 137/529 |
| 4,012,012 | A | * | 3/1977 | Ligler | 244/1 R |
| 4,027,643 | A | | 6/1977 | Feenan et al. | |
| 4,252,094 | A | * | 2/1981 | Draxler | 123/198 DB |
| 4,270,562 | A | | 6/1981 | Oberth et al. | |
| 4,370,956 | A | | 2/1983 | Moser et al. | |
| 4,391,296 | A | * | 7/1983 | Abbott | 137/522 |
| 4,452,188 | A | * | 6/1984 | Kosuda et al. | 123/196 R |
| 4,473,093 | A | * | 9/1984 | Hart | 137/522 |
| 4,647,008 | A | * | 3/1987 | Shirai et al. | 251/129.07 |
| 4,792,113 | A | * | 12/1988 | Eidsmore | 137/460 |
| 5,056,556 | A | * | 10/1991 | Nishimoto et al. | 137/522 |
| 5,113,658 | A | * | 5/1992 | Kobayashi | 60/608 |
| 5,339,776 | A | | 8/1994 | Requeiro | |
| 5,346,175 | A | * | 9/1994 | Hunnicutt | 137/529 |
| 5,517,959 | A | * | 5/1996 | Kato et al. | 123/196 AB |
| 5,593,133 | A | * | 1/1997 | Hunnicutt | 137/242 |
| 5,597,051 | A | * | 1/1997 | Moriya et al. | 123/196 R |
| 5,819,692 | A | * | 10/1998 | Schafer | 123/41.35 |
| 5,884,601 | A | * | 3/1999 | Robinson | 123/196 A |
| 5,979,168 | A | * | 11/1999 | Beekman | 417/310 |

* cited by examiner

*Primary Examiner*—Charles G. Freay
*Assistant Examiner*—Timothy P. Solak
(74) *Attorney, Agent, or Firm*—Brooks & Kushman; Carlos L. Hanze

(57) ABSTRACT

A variable pressure oil pump assembly for use with a vehicle having a controller includes a pump body having an inlet, an outlet, a valve chamber, a first passage disposed between the inlet and the valve chamber, and a second passage disposed between the outlet and the valve chamber. The assembly further includes a pressure relief valve subassembly having a movable plunger that is disposed at least partially in the valve chamber for controlling flow of oil through the valve chamber so as to control outlet oil pressure at the outlet. A plunger adjustment mechanism is associated with the valve subassembly and adapted to communicate with the controller. The plunger adjustment mechanism is operable to control movement of the plunger based on control signals provided by the controller.

12 Claims, 6 Drawing Sheets

VISCOSITY SENSOR
COOLANT TEMP SENSOR
SPEED SENSOR
LOAD SENSOR
ECU
$T_{OUT}$
$P_{OUT}$
OIL FILTER
$T_{SUMP}$
10
12
14
16
18
19
20
22
24
26
27
28
30
32
34
36
38
40
42
44
46
48
50
51
52
53
64
66
67
68
70
72
73
74

VARIABLE PRESSURE OIL PUMP

BACKGROUND OF INVENTION

The invention relates to a variable pressure oil pump for use with an engine, such as an internal combustion engine of a motor vehicle.

A typical motor vehicle includes an internal combustion engine and a lubrication system for providing oil to various lubrication locations of the engine. Such lubrication locations include sleeve bearings that support a rotating shaft, such as a camshaft. The oil produces a viscous friction drag on the rotating shaft, and the frictional drag converts mechanical energy from the shaft into heat energy within the oil. To prevent the oil from overheating within the bearings, the bearings are continually provided pressurized, lower temperature oil from an oil pump of the lubrication system. The pressurized, lower temperature oil is forced into the bearings and displaces heated oil out of the bearings.

When the engine is cold, such as during a cold start, however, the oil in the bearings is cold and the viscosity of the oil is high. As a result, it is not desirable to replace this oil with pressurized, low temperature oil.

Systems have been developed to vary oil pressure of oil provided to bearings of an internal combustion engine. U.S. Pat. No. 5,339,776, for example, discloses a lubrication system that includes an oil pump that draws oil from an oil sump, and a bypass valve that is capable of diverting oil supplied by the oil pump back into the oil sump without routing the oil to the bearings. Because high pressure oil is dumped back into the sump, however, aeration of the oil may occur. Furthermore, the oil dumped back into the sump will likely experience significant heat loss.

SUMMARY OF INVENTION

The present invention addresses the shortcomings of the prior art by providing a variable pressure oil pump assembly that can vary outlet oil pressure based on one or more operating conditions. Furthermore, outlet oil pressure may be varied without diverting high pressure oil into an oil sump.

Under the invention, a variable pressure oil pump assembly for use with a vehicle having a controller includes a pump body having an inlet, an outlet, a valve chamber, a first passage disposed between the inlet and the valve chamber, and a second passage disposed between the outlet and the valve chamber. The assembly further includes a pressure relief valve subassembly having a movable plunger that is disposed at least partially in the valve chamber for controlling flow of oil through the valve chamber so as to control outlet oil pressure at the outlet. A plunger adjustment mechanism is associated with the valve subassembly and adapted to communicate with the controller. The plunger adjustment mechanism is operable to control movement of the plunger based on control signals provided by the controller.

The plunger adjustment mechanism may be any suitable mechanism that is configured to affect movement of the plunger. For example, the plunger adjustment mechanism may include a solenoid subassembly connected to the pump body and adapted to be electrically connected to the controller. With such a configuration, when the solenoid subassembly is energized, the solenoid subassembly draws the plunger toward an open position for allowing oil to flow through the valve chamber.

In another embodiment of the invention, the plunger has an enlarged head having first and second sides, and the plunger adjustment mechanism includes a housing connected to the pump body and defining a housing chamber that receives the enlarged head. Furthermore, the housing including first and second apertures. The first aperture is in fluid communication with the first side of the enlarged head. The second aperture is in fluid communication with the second side of the enlarged head and is further connected to the inlet. In addition, the plunger adjustment mechanism includes a solenoid valve adapted to be electrically connected to the controller and further connected to the first aperture, the inlet and the outlet. When the solenoid valve is energized, the first aperture is exposed to the outlet oil pressure. When the solenoid valve is de-energized, the first aperture is exposed to inlet oil pressure.

In yet another embodiment of the invention, the plunger has an enlarged head having first and second sides, and the plunger adjustment mechanism includes a housing connected to the pump body and defining a housing chamber that receives the enlarged head. Furthermore, the housing includes first and second apertures. The first aperture is in fluid communication with the first side of the enlarged head. The second aperture is in fluid communication with. the second side of the enlarged head and is further connected to the inlet so as to expose the second side of the enlarged head to inlet oil pressure. In addition, the plunger adjustment mechanism includes an additional pump connected between the first aperture and the inlet and adapted to be electrically connected to the controller. When the additional pump is not activated, the additional pump provides the inlet oil pressure to the first aperture. When the additional pump is activated, the additional pump provides oil pressure to the first aperture that is greater than the inlet oil pressure.

These and other objects, features, and advantages of the present invention are readily apparent from the following detailed description of the preferred embodiments when taken in connection with the accompanying drawings.

DETAILED DESCRIPTION

Figure 1:
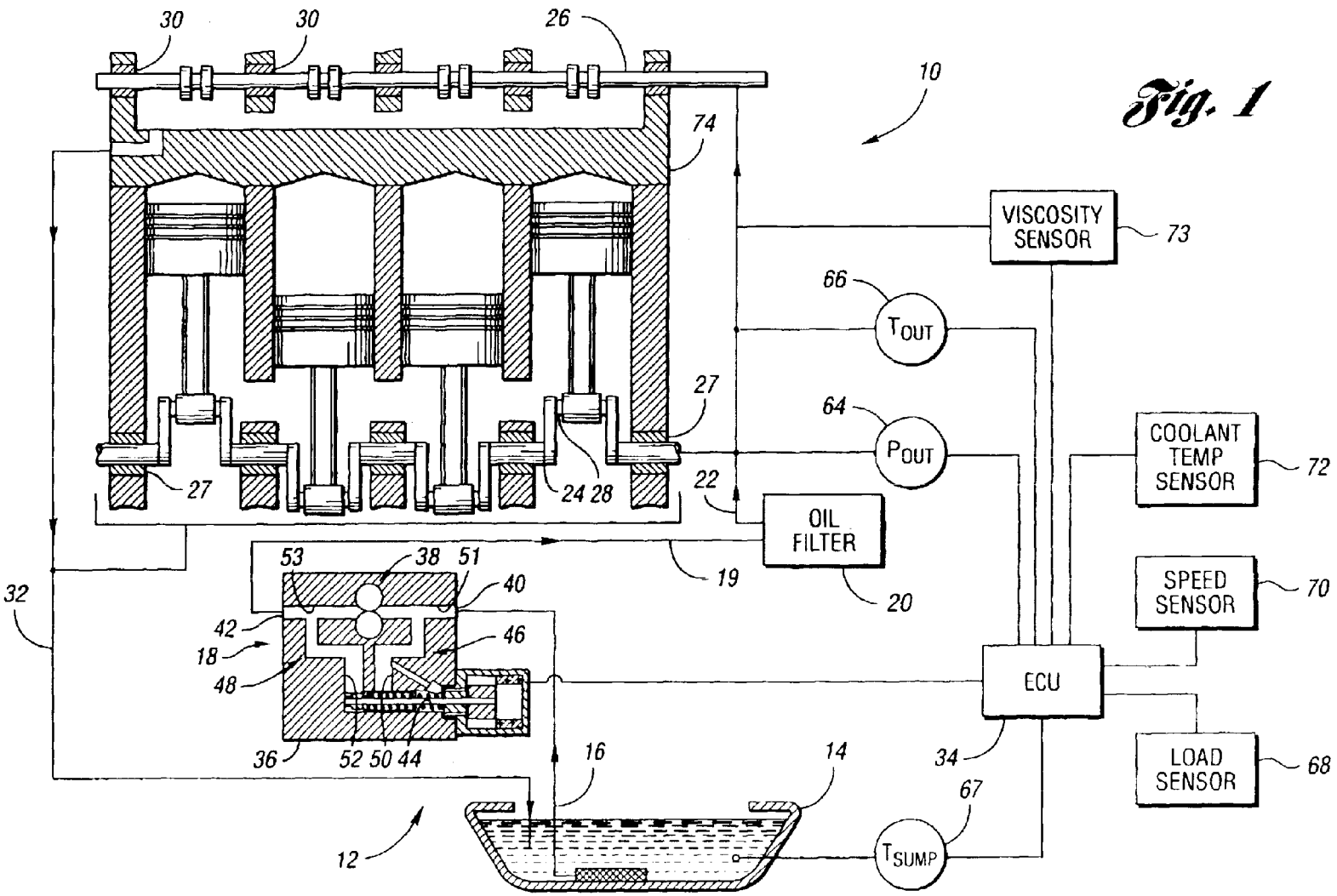
FIG. 1 is a schematic diagram of an engine that incorporates a lubrication system according to the invention, wherein the lubrication system includes an oil pump assembly that provides pressurized oil to lubrication locations of the engine.

FIG. 1 shows an automotive internal combustion engine 10 that incorporates a lubrication system 12 according to the invention. The lubrication system 12 includes an oil sump or pan 14 and a suction pipe 16 that routes oil from the oil pan 14 to an oil pump assembly 18. The oil pump assembly 18 provides pressurized oil to a discharge pipe 19, which leads to an oil filter 20. An oil passage such as a main gallery 22 leads from the filter 20 to a crankshaft 24 and a camshaft 26 of the engine 10. Internal passages (not shown) through the crankshaft 24 provide oil to crankshaft bearings 27 and connecting rod bearings 28. Similarly, internal passages (not shown) through the camshaft 26 provide oil to camshaft bearings 30. Gravity drains 32 return the oil to the oil pan 14. The lubrication system 12 also includes an electronic controller, such as electronic control unit 34, that is connected to the oil pump assembly 18.

Figure 2:
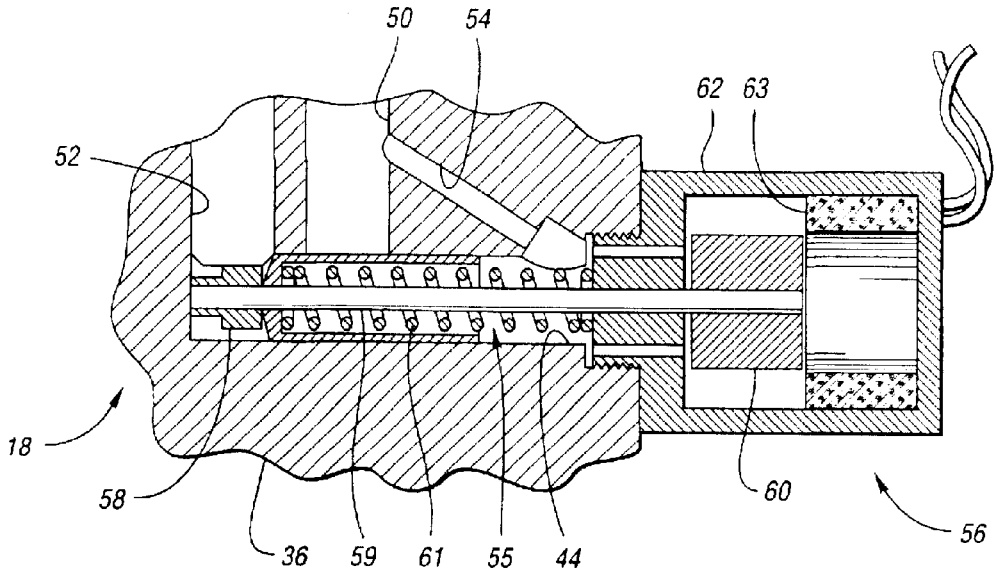
FIG. 2 is a enlarged fragmentary view of the oil pump assembly showing a plunger of the oil pump assembly in a seated position.
Figure 3:
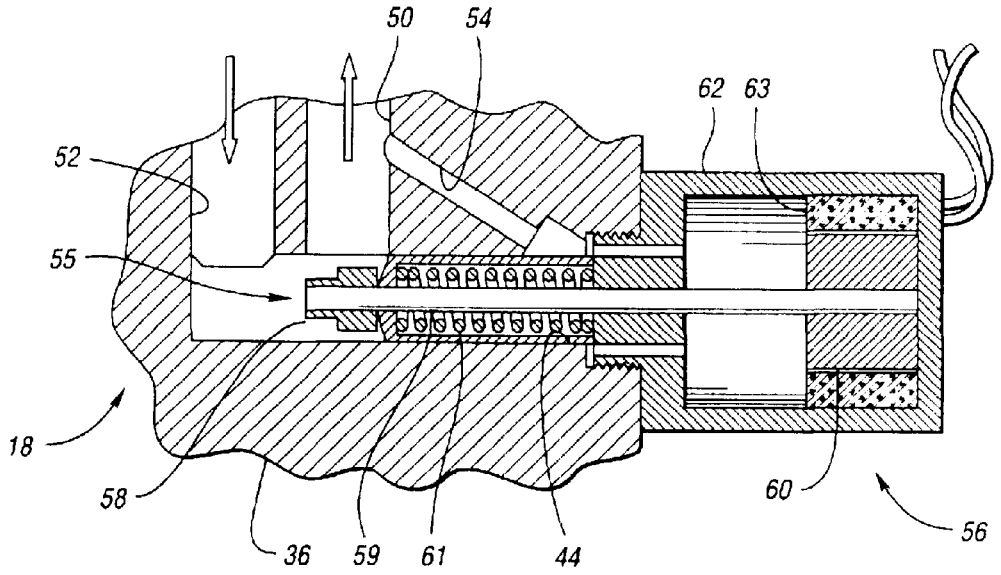
FIG. 3 is a enlarged fragmentary view of the oil pump assembly showing the plunger in an open position.

Referring to FIGS. 1 through 3, the oil pump assembly 18 includes a pump body 36 and a pump element 38 disposed in the pump body 36 for pressurizing the oil. The pump body 36 has an inlet 40 connected to the suction pipe 16, and an outlet 42 connected to the discharge pipe 19. The pump body 36 further includes a valve chamber 44, a first or low pressure passage arrangement 46 in fluid communication with the valve chamber 44, and a second or high pressure passage arrangement 48. The first passage arrangement 46 includes a first passage 50 disposed between the inlet 40 and the valve chamber 44, and an inlet passage 51 extending between the inlet 40 and the pump element 38. The second passage arrangement 48 includes a second passage 52 extending between the outlet 42 and the valve chamber 44, and an outlet passage 53 extending between the pump element 38 and the outlet 42. In addition, the pump body 36 includes a connector passage 54 extending between the valve chamber 44 and the first passage 50.

The oil pump assembly 18 further includes a relief valve subassembly 55 and a plunger adjustment mechanism 56 associated with the valve subassembly 55. The valve subassembly 55 includes a piston or plunger 58 that is disposed at least partially in the valve chamber 44. The plunger 58 is movable between a seated position, shown in FIG. 2, and an open position shown in FIG. 3. The plunger 58 includes a plunger body 59 and a head 60 connected to the plunger body 59. A passage (not shown) may also be provided through the head 60 to allow oil and/or air that is displaced by head 60 to flow from one side of the head 60 to the other side of the head 60. While the plunger 58 may comprise any suitable material, in the embodiment shown in FIGS. 2 and 3, the plunger body 59 comprises steel, and the head 60 comprises iron.

The valve subassembly 55 also includes a spring 61 that biases the plunger 58 toward the seated position. The plunger 58 is movable against the bias of the spring 61 when a sufficient pressure differential exists between the second passage 52 and the first passage 50. Furthermore, the plunger 58 is movable against the bias of the spring 61 when the plunger adjustment mechanism 56 is activated as described below in detail.

In the embodiment shown in FIGS. 1 through 3, the plunger adjustment mechanism 56 is a solenoid subassembly that includes a housing 62 and a solenoid winding 63 attached to the housing 62. Furthermore, the solenoid winding 63 is electrically connected to the electronic control unit 34. When the solenoid winding 63 is de-energized, the plunger 58 moves between the seated position and the open position based on the pressure differential existing between the first and second passages 50 and 52, respectively. When the solenoid winding 63 is energized, the head 60 of the plunger 58 is drawn toward the solenoid winding 63, thereby causing the plunger 58 to move toward the open position shown in FIG. 3. Thus, plunger adjustment mechanism 56 may provide a force that acts on plunger 58, in addition to the force created by the pressure differential between the passages 50 and 52, to move the plunger 58 against the bias of the spring 61 toward the open position. Alternatively, the plunger adjustment mechanism 56 may be any suitable mechanism that is configured to affect movement of the plunger 58.

Referring to FIG. 1, the electronic control unit 34 is in communication with a plurality of sensors, such as oil pressure sensor 64, oil temperature sensors 66 and 67, engine load sensor 68, engine speed sensor 70, coolant temperature sensor 72, and oil viscosity sensor 73. Based on input received from the sensors 64–73, the electronic control unit 34 generates appropriate control signals for controlling operation of the plunger adjustment mechanism 56.

Electronic control unit 34 may be provided as part of oil pump assembly 18. For example, electronic control unit 34 may be mounted on or proximate to pump body 36. Alternatively, electronic control unit 34 may be provided as a separate component from oil pump assembly 18. For example, electronic control unit 34 may be an engine controller that is mounted on or proximate to engine block 74 of engine 10. With such a configuration, electronic control unit 34 may be used to control other components of engine 10, such as a fuel supply system (not shown) and/or a coolant system (not shown).

Referring to FIGS. 1 through 3, operation of engine 10 having lubrication system 12 will now be described in detail. It is understood that bearings 27, 28 and 30 are typically designed to have a leakage rate that will allow an adequate amount of oil to flow through the bearings 27, 28 and 30 to maintain a non-damaging temperature under the most severe operating conditions. Under normal operating conditions, however, this flow of oil may cause the bearings 27, 28 and 30 to operate at lower temperatures than necessary. These lower temperatures may result in more fuel consuming friction between the bearings 27, 28 and 30 and the oil. Advantageously, the lubrication system 12 is able to adjust oil pressure under such operating conditions, as well as other operating conditions, so as to vary the amount of oil flowing through the bearings 27, 28 and 30.

The electronic control unit 34 continually receives input from the sensors 64–73 so as to monitor engine operating conditions. Based on these operating conditions, the electronic control unit 34 determines desired oil pressure for the lubrication system 12. The electronic control unit 34 then generates appropriate control signals for controlling operation of the plunger adjustment mechanism 56 so as to regulate oil pressure.

For example, under low engine load conditions such as normal operating conditions and/or startup conditions, the electronic control unit 34 may energize the solenoid winding 63 so as to move the plunger 58 toward the open position shown in FIG. 3. As a result, high pressure oil will flow from the second passage 52 to the first passage 50, thereby reducing outlet oil pressure at outlet 42.

As another example, as engine loads increase above a predetermined level, the electronic control unit 34 may de-energize solenoid winding 63. Consequently, the plunger 58 will move between the seated and open positions based on the pressure differential between the passages 50 and 52 only.

The electronic control unit 34 may also generate appropriate control signals to achieve a desired duty cycle for the solenoid winding 63. Moreover, the clearance between the head 60 and the housing 62 may be appropriately designed to achieve a damping effect as the plunger 58 moves between the seated and open positions. With such a configuration, the plunger 58 may maintain an intermediate position between the seated and open positions, or intermediate range of positions between the seated and open positions, for a particular duty cycle. Furthermore, by varying the duty cycle, the intermediate position or intermediate range of positions of the plunger 58 may be varied so as to provide desired oil pressure to the bearings 27, 28 and 30.

For example, at periodic intervals, measurements may be taken with the various sensors 64–73, and the electronic control unit 34 may calculate an inferred oil film thickness within the bearings 27, 28 and 30 based on the measurements. If the inferred oil film thickness is too low or too high for the particular engine speed and/or engine load, then the duty cycle for the solenoid winding 63 may be adjusted so as to increase or decrease oil pressure provided to the bearings 27, 28 and 30.

As oil passes through the oil pump assembly 18, the pump element 38 consumes mechanical energy so as to increase pressure of the oil. For example, the pump element 38 may be driven either directly or indirectly by the crankshaft 24, or by other suitable means. Part of the mechanical energy is converted to thermal energy within the oil due to such factors as friction and shearing of the oil. The rest of the mechanical energy is converted into hydraulic energy (oil pressure increase times the volume of oil pumped). When the pressure of the oil eventually drops, such as within the bearings 27, 28 and 30 or across the relief valve subassembly 55, this hydraulic energy is converted into thermal energy. Thus, virtually all of the mechanical energy consumed by the pump element 38 is converted into thermal energy within the oil.

When the relief valve subassembly 55 allows high pressure, high temperature oil to be passed directly from second passage 52 to first passage 50, the temperature of the oil on the inlet side of pump element 38 is increased. Consequently oil entering the pump element 38 has reduced viscosity, which results in improved efficiency of the oil pump assembly 18. Moreover, the temperature of oil exiting the oil pump assembly 18 is increased, and, as a result, viscous friction within the bearings 27, 28 and 30 is reduced.

The lubrication system 12 also provides several other advantages. First, because high pressure oil is not returned to the oil pan 14, potential aeration of the oil in the oil pan 14 is inhibited. Second, if the plunger mechanism 56 fails for any reason, the plunger 58 can still move between the seated and open positions based on the pressure differential between the passages 50 and 52.

Figure 4:
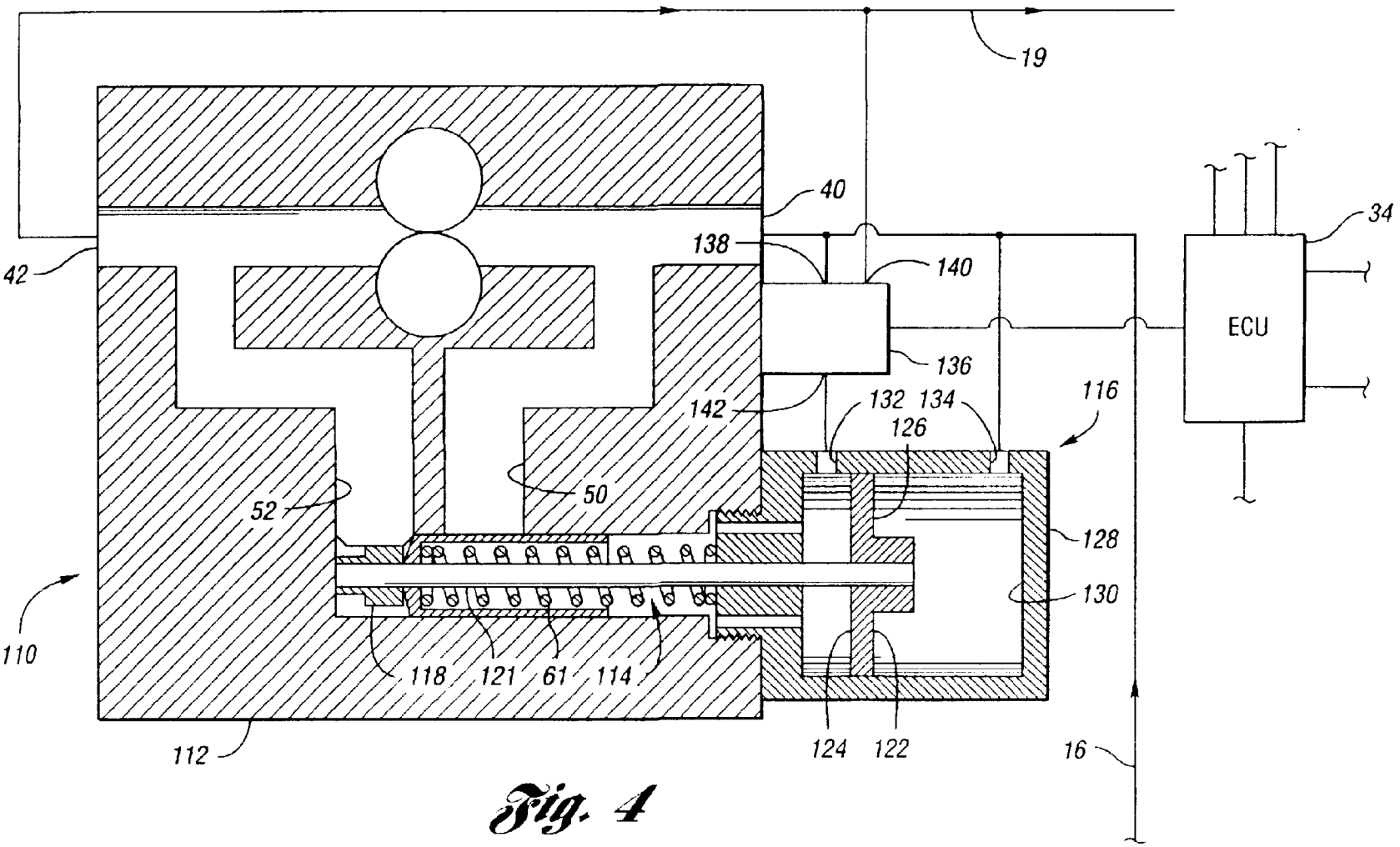
FIG. 4 is a schematic view of a second embodiment of the oil pump assembly showing a plunger of the oil pump assembly in a seated position.
Figure 5:
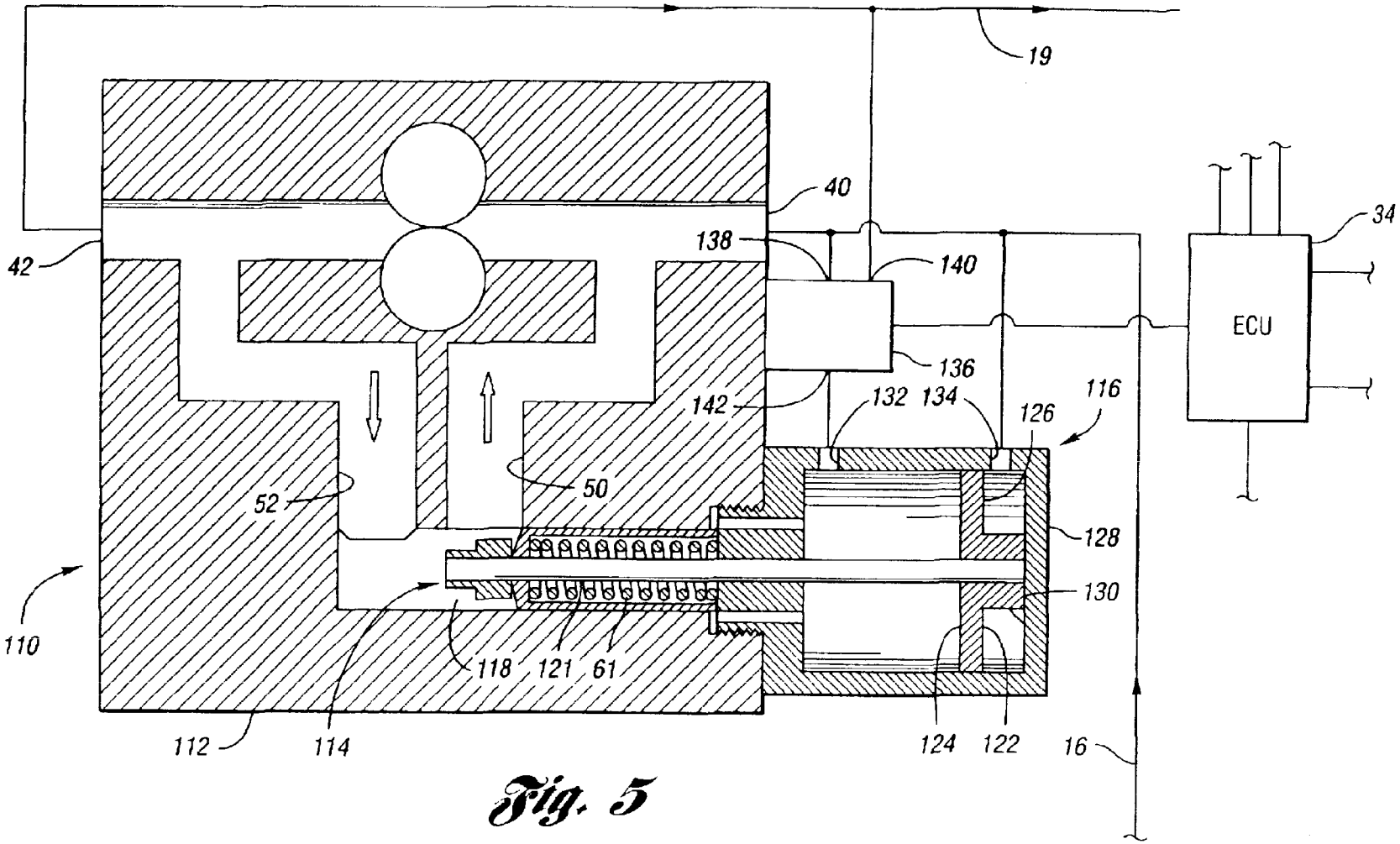
FIG. 5 is a schematic view of the second embodiment of the oil pump assembly showing the plunger in an open position.

FIGS. 4 and 5 show a second embodiment 110 of the oil pump assembly. The oil pump assembly 110 includes a pump body 112, a pressure relief valve subassembly 114 and a plunger adjustment mechanism 116. The pump body 112 is similar to the pump body 36 of the oil pump assembly 10. Consequently, similar elements common to both the pump body 112 and the pump body 36 have been given the same reference numerals. The pump body 112, however, may be provided without connector passage 54 of pump body 36.

The valve subassembly 114 is similar to the valve subassembly 55, and includes a plunger 118 and spring 61. The plunger 118 has a plunger body 121 and an enlarged portion, such as head 122, having a first side 124 and a second side 126. The plunger 118 is movable between a seated position shown in FIG. 4, and an open position shown in FIG. 5.

The plunger adjustment mechanism 116 includes a housing 128 that is connected to the pump body 112 and defines a housing chamber 130 for receiving the head 122. Preferably, the housing 128 forms a seal with the outer perimeter of the enlarged head 122. The housing 128 further includes first and second apertures 132 and 134, respectively. The first aperture 132 is in fluid communication with the first side 124 of the enlarged head 122, and the second aperture 134 is in fluid communication with the second side 126 of the enlarged head 122. The second aperture 134 is also connected to inlet 40 of pump body 112.

The plunger adjustment mechanism 116 also includes a suitable valve, such as solenoid valve 136, that is mounted on the pump body 112 and is connected to electronic control unit 34. Alternatively, the solenoid valve 136 may be spaced away from the pump body 112.

The solenoid valve 136 has first and second inlet ports 138 and 140, respectively, and an outlet port 142. The first inlet port 138 is connected to inlet 40 of pump body 112, the second inlet port 140 is connected to the outlet 42 of pump body 112, and the outlet port 142 is connected to the first aperture 132. When the solenoid valve 136 is de-energized, both sides 124 and 126 of the enlarged head 122 are exposed to the same pressure. As a result, the plunger adjustment mechanism 116 exerts no net force on the plunger 118, and the plunger 118 moves between the seated and open positions based on the pressure differential between the passages 50 and 52. When the solenoid valve 136 is energized by electronic control unit 34, outlet oil pressure is provided to the first aperture 132, thereby urging the plunger 118 toward the open position shown in FIG. 5. Thus, plunger adjustment mechanism 116 may provide a force that acts on plunger 118, in addition to the force created by the pressure differential between the passages 50 and 52, to move the plunger 118 against the bias of the spring 61 toward the open position. Furthermore, duty cycle of the solenoid valve 136 may be adjusted, in a similar manner as described above, so as to achieve a desired intermediate position between the seated and open positions, or intermediate range of positions between the seated and open positions, for the plunger 118.

Figure 6:
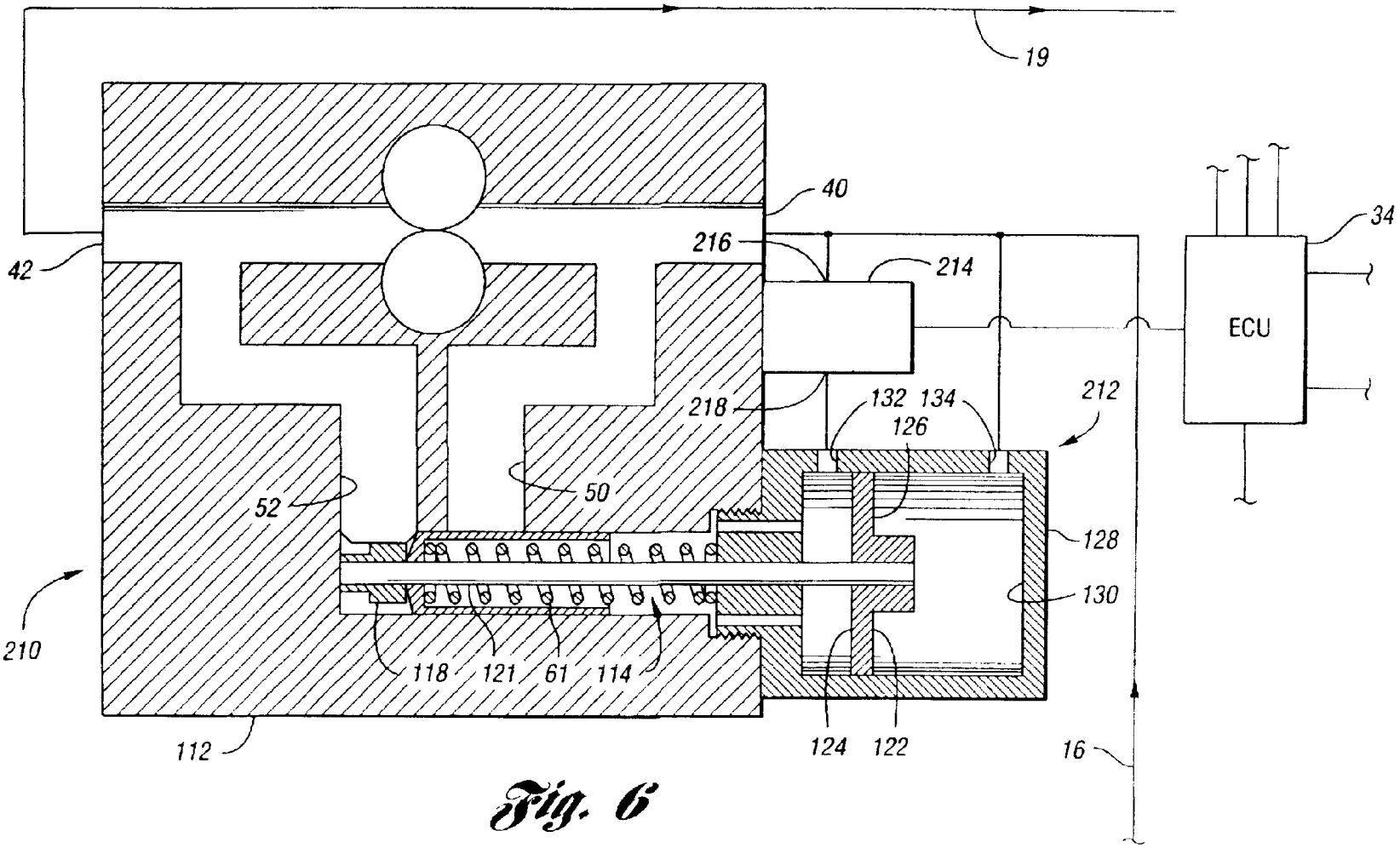
FIG. 6 is a schematic view of a third embodiment of the oil pump assembly showing a plunger of the oil pump assembly in a seated position.
Figure 7:
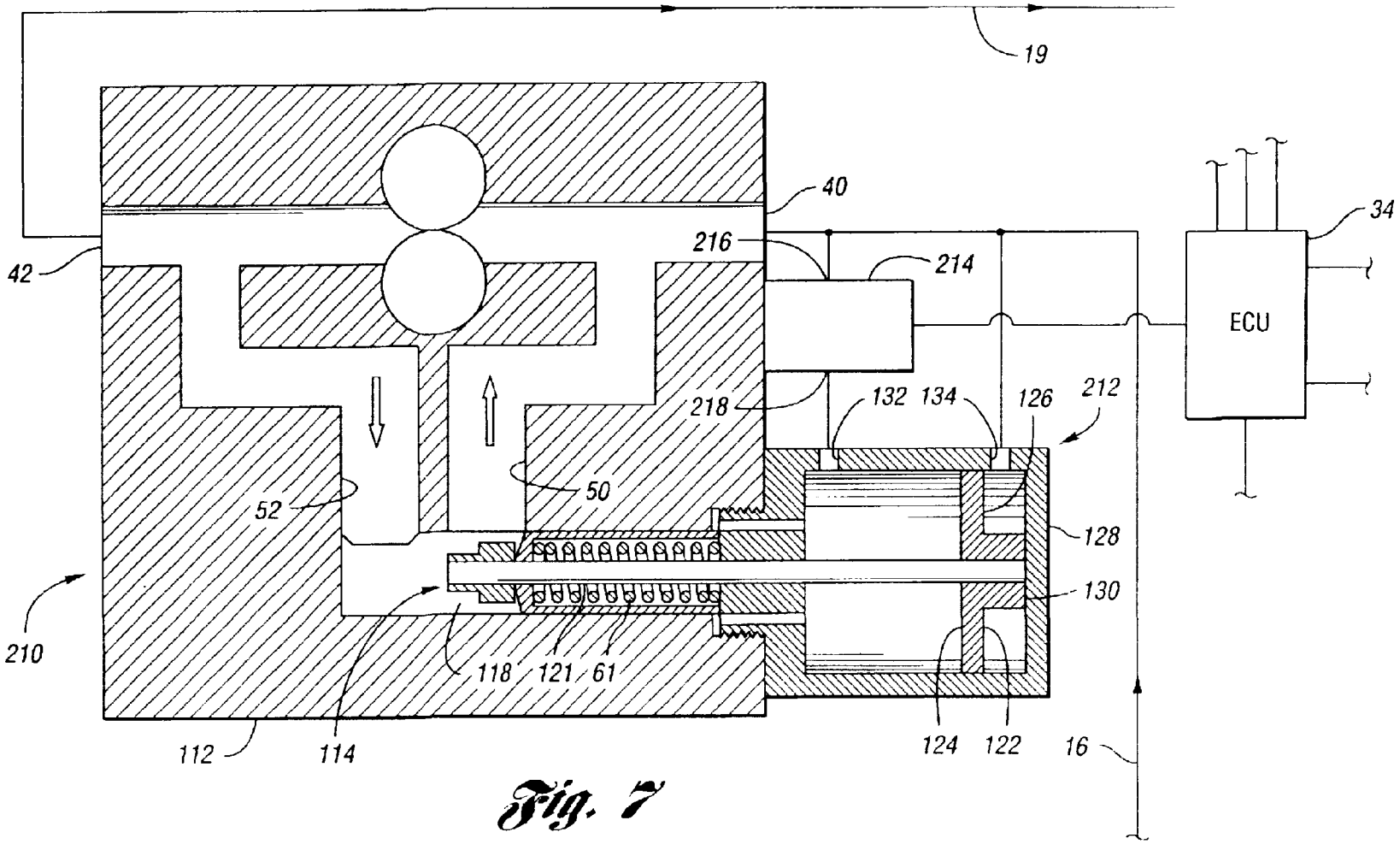
FIG. 7 is a schematic view of the third embodiment of the oil pump assembly showing the plunger in an open position.

FIGS. 6 and 7 show a third embodiment 210 of the oil pump assembly. The oil pump assembly 210 includes pump body 112 and relief valve subassembly 114 of the oil pump assembly 110, and further includes a plunger adjustment mechanism 212. The plunger adjustment mechanism 212 is similar to the plunger adjustment mechanism 116, and includes housing 128. The plunger adjustment mechanism 212 further includes an additional pump 214 having an inlet 216 connected to inlet 40 of pump body 112, and an outlet 218 connected to first aperture 132 of the housing 128. The additional pump 214 is also connected to electronic control unit 34. Furthermore, the additional pump 214 may be mounted on the pump body 112, as shown in FIG. 6, or the additional pump 214 may be spaced away from the pump body 112.

When the additional pump 214 is not activated, inlet oil pressure is provided to the first aperture 132. With such an arrangement, plunger 118 moves between a seated position, shown in FIG. 6, and an open position, shown in FIG. 7, based on the pressure differential between passages 50 and 52. When the additional pump 214 is activated by electronic control unit 34, the additional pump 214 provides oil pressure to the first aperture 132 that is higher than inlet oil pressure. As a result, the piston 118 is urged toward the open position shown in FIG. 7. Thus, plunger adjustment mechanism 212 may provide a force that acts on plunger 118, in addition to the force created by the pressure differential between the passages 50 and 52, to move the plunger 118 against the bias of the spring 61 toward the open position. Furthermore, duty cycle of the additional pump 214 may be adjusted, in a similar manner as described above, so as to achieve a desired intermediate position between the seated and open positions, or intermediate range of positions between the seated and open positions, for the plunger 118.

In each of the above embodiments, the electronic control unit 34 provides necessary power for controlling operation of the plunger adjustment mechanism 56, 116 or 212. Alternatively, an additional power source (not shown) may be connected to the plunger adjustment mechanism 56, 116, or 212, such as between the electronic control unit 34 and the plunger adjustment mechanism 56, 116 or 212.

While the best mode for carrying out the invention has been described in detail, those familiar with the art to which this invention relates will recognize various alternative designs and embodiments for practicing the invention as defined by the following claims.

What is claimed is:

1. An oil pump assembly for use with a vehicle having a controller, the assembly comprising:

a pump body having an inlet, an outlet, a valve chamber, a first passage disposed between the inlet and the valve chamber, and a second passage disposed between the outlet and the valve chamber;

a pressure relief valve subassembly including a movable plunger that is disposed at least partially in the valve chamber for controlling flow of oil through the valve chamber so as to control outlet oil pressure at the outlet, the plunger being movable between a seated position for inhibiting flow of oil through the valve chamber and an open position for allowing oil to flow through the valve chamber; and an energizable plunger adjustment mechanism associated with the valve subassembly and adapted to communicate with the controller for controlling movement of the plunger based on control signals provided by the controller, wherein the plunger adjustment mechanism is configured to draw the plunger toward the open position when the plunger adjustment mechanism is energized, and wherein the plunger is moveable between the seated position and the open position based on pressure differences between the first and second passages when the plunger adjustment mechanism is de-energized.

2. The assembly of claim 1 wherein the valve subassembly comprises a spring that biases the plunger toward the seated position.

3. The assembly of claim 1 wherein the plunger adjustment mechanism includes a solenoid subassembly for controlling movement of the plunger, the solenoid subassembly being connected to the pump body and adapted to be electrically connected to the controller.

4. The assembly of claim 3 wherein the valve subassembly comprises a spring that biases the plunger toward the seated position.

5. An oil pump assembly for use with a vehicle having a controller, the assembly comprising:

a pump body having an inlet, an outlet, a valve chamber, a first passage disposed between the inlet and the valve chamber, and a second passage disposed between the outlet and the valve chamber;

a pressure relief valve subassembly including a movable plunger that is disposed at least partially in the valve chamber for controlling flow of oil through the valve chamber so as to control outlet oil pressure at the outlet, the plunger including an enlarged head having first and second sides; and a plunger adjustment mechanism associated with the valve subassembly and adapted to communicate with the controller, the plunger adjustment mechanism being operable to control movement of the plunger based on control signals provided by the controller, the plunger adjustment mechanism including a housing connected to the pump body and defining a housing chamber that receives the enlarged head, the housing including first and second apertures, the first aperture being in fluid communication with the first side of the enlarged head, the second aperture being in fluid communication with the second side of the enlarged head and further being connected to the inlet so as to expose the second side of the enlarged head to inlet oil pressure, the plunger adjustment mechanism further including an additional pump connected between the first aperture and the inlet and adapted to be electrically connected to the controller, wherein the additional pump is configured to provide the inlet oil pressure to the first aperture when the additional pump is not activated, and to provide oil pressure to the first aperture that is greater than the inlet oil pressure when the additional pump is activated.

6. An oil pump assembly for use with a vehicle having a controller, the assembly comprising:

a pump body having an inlet, an outlet, a first passage arrangement in fluid communication with the inlet, a second passage arrangement in fluid communication with the outlet, and a valve chamber disposed between the passage arrangements;

a pressure relief valve subassembly including a movable plunger that is disposed at least partially in the valve chamber for controlling flow of oil through the valve chamber so as to control outlet oil pressure at the outlet, the plunger including a head having first and second sides; and a plunger adjustment mechanism associated with the valve subassembly and adapted to communicate with the controller, the plunger adjustment mechanism being operable to control movement of the plunger based on control signals provided by the controller, the plunger adjustment mechanism including a housing connected to the pump body and defining a housing chamber that receives the head, the housing including first and second apertures, the first aperture being in fluid communication with the first side of the head, the second aperture being in fluid communication with the second side of the head and further being connected to the inlet, the plunger adjustment mechanism further including a valve adapted to be electrically connected to the controller and further connected to the first aperture, the inlet and the outlet, wherein the valve is operable to selectively expose the first aperture to the outlet oil pressure and inlet oil pressure.

7. The oil pump assembly of claim 6 wherein the valve is a solenoid valve.

8. The oil pump assembly of claim 6 wherein the valve is an energizable valve that is configured to expose the first aperture to the outlet oil pressure when the valve is energized, and to expose the first aperture to the inlet oil pressure when the valve is de-energized.

9. A lubrication system for supplying oil to an engine, the system comprising:

an oil pump assembly including a pump body having an inlet, an outlet, a first passage arrangement in fluid communication with the inlet, a second passage arrangement in fluid communication with the outlet, and a valve chamber disposed between the passage arrangements, the oil pump assembly further including a pressure relief valve subassembly having a movable plunger that is disposed at least partially in the valve chamber for controlling flow of oil through the valve chamber so as to control outlet oil pressure at the outlet, and a plunger adjustment mechanism associated with the valve subassembly for controlling movement of the plunger, the plunger including an enlarged head having first and second sides, the plunger adjustment mechanism including a housing connected to the pump body and defining a housing chamber that receives the enlarged head, the housing including first and second apertures, the first aperture being in fluid communication with the first side of the enlarged head, the second aperture being in fluid communication with the second side of the enlarged head and further being connected to the inlet, the plunger adjustment mechanism further including a valve connected to the first aperture, the inlet and the outlet, the valve being operable to selectively expose the first aperture to the outlet oil pressure and inlet oil pressure; and an electronic controller electrically connected to the valve for controlling operation of the valve.

10. The lubrication system of claim 9 wherein the valve is a solenoid valve.

11. The lubrication system of claim 9 wherein the valve is an energizable valve that is configured to expose the first aperture to the outlet oil pressure when the valve is energized, and to expose the first aperture to the inlet oil pressure when the valve is de-energized.

12. A lubrication system for supplying oil to an engine, the system comprising:

an oil pump assembly including a pump body having an inlet, an outlet, a first passage arrangement in fluid communication with the inlet, a second passage arrangement in fluid communication with the outlet, and a valve chamber disposed between the passage arrangements, the oil pump assembly further including a pressure relief valve subassembly having a movable plunger that is disposed at least partially in the valve chamber for controlling flow of oil through the valve chamber so as to control outlet oil pressure at the outlet, and a plunger adjustment mechanism associated with the valve subassembly for controlling movement of the plunger, the plunger having an enlarged head having first and second sides, the plunger adjustment mechanism including a housing connected to the pump body and defining a housing chamber that receives the enlarged head, the housing including first and second apertures, the first aperture being in fluid communication with the first side of the enlarged head, the second aperture being in fluid communication with the second side of the enlarged head and further being connected to the inlet so as to expose the second side of the enlarged head to inlet oil pressure, the plunger adjustment mechanism further including an additional pump connected between the first aperture and the inlet and electrically connected to the controller, wherein when the additional pump is not activated, the additional pump provides the inlet oil pressure to the first aperture, and when the additional pump is activated, the additional pump provides oil pressure to the first aperture that is greater than the inlet oil pressure; and an electronic controller electrically connected to the plunger adjustment mechanism for controlling operation of the plunger adjustment mechanism.

* * * * *